US009359849B2

(12) United States Patent
Nguyen

(10) Patent No.: US 9,359,849 B2
(45) **Date of Patent: *Jun. 7, 2016**

(54) METHOD AND SYSTEM FOR HYDRAULICALLY PRESETTING A METAL SEAL

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/598,216

(22) Filed: Jan. 15, 2015

(65) Prior Publication Data

US 2015/0129243 A1 May 14, 2015

Related U.S. Application Data

(63) Continuation of application No. 13/063,927, filed as application No. PCT/US2009/059877 on Oct. 7, 2009, now Pat. No. 8,944,172.

(60) Provisional application No. 61/114,944, filed on Nov. 14, 2008.

(51) Int. Cl.

| | |
|---|---|
| ***E21B 33/04*** | (2006.01) |
| ***E21B 33/03*** | (2006.01) |
| ***E21B 17/042*** | (2006.01) |

(52) U.S. Cl.

CPC ..... *E21B 33/03* (2013.01); *E21B 17/042* (2013.01); *E21B 33/04* (2013.01)

(58) Field of Classification Search

USPC ..... 166/387, 75.11, 85.1, 85.3, 382, 378, 166/379, 381; 277/312, 314, 339

See application file for complete search history.

(56) References Cited

U.S. PATENT DOCUMENTS

| | | | |
|---|---|---|---|
| 3,924,679 | A | 12/1975 | Jansen, Jr. |
| 4,284,142 | A | 8/1981 | Kirkland |
| 4,556,224 | A | 12/1985 | Le |
| 4,561,499 | A | 12/1985 | Berner et al. |
| 4,588,029 | A | 5/1986 | Blizzard |
| 4,641,841 | A | 2/1987 | Regan |
| 4,650,225 | A | 3/1987 | Le et al. |
| 4,653,589 | A | 3/1987 | Alandy |
| 4,718,679 | A | 1/1988 | Vyvial |
| 4,749,035 | A | 6/1988 | Cassity |

(Continued)

OTHER PUBLICATIONS

PCT International Search Report and Written Opinion of PCT Application No. PCT/US2009/059877; Dated Jun. 9, 2010; 17 pages.

*Primary Examiner* — Taras P Bemko

(74) *Attorney, Agent, or Firm* — Fletcher Yoder P.C.

(57) ABSTRACT

A system and method is provided for hydraulically presetting a metal-to-metal seal, which may be installed in an annular space between wellhead components. A hydraulic running tool may be landed on a first wellhead component and coupled to a second wellhead component, for example, via a hydraulic or mechanical coupling assembly. Fluid pressure may then be applied to the hydraulic running tool to move the components axially together, thereby setting the metal-to-metal seal (i.e., axially compressing and radially expanding the seal). A coupling may secure the wellhead components in place relative to one another, while fluid pressure is being applied so that the metal-to-metal seal remains in the set position after the hydraulic tool is removed.

33 Claims, 9 Drawing Sheets

(56) References Cited

U.S. PATENT DOCUMENTS

| | | | |
|---|---|---|---|
| 4,794,988 | A | 1/1989 | Van Bilderbeek |
| 4,823,871 | A | 4/1989 | McEver et al. |
| 4,938,289 | A | 7/1990 | Van Bilderbeek |
| 5,080,174 | A | 1/1992 | Hynes |
| 5,114,158 | A | 5/1992 | Le et al. |
| 5,158,326 | A | 10/1992 | Anderson et al. |
| 5,325,925 | A | 7/1994 | Smith et al. |
| 5,364,110 | A | 11/1994 | Streich et al. |
| 5,524,710 | A | 6/1996 | Shinn |
| 5,655,603 | A * | 8/1997 | Schulte ..... E21B 33/043 166/368 |
| 6,648,335 | B1 | 11/2003 | Ezell |
| 6,969,070 | B2 | 11/2005 | Reimert et al. |
| 7,028,777 | B2 | 4/2006 | Wade et al. |
| 7,111,688 | B2 | 9/2006 | Van Bilderbeek |
| 7,861,789 | B2 | 1/2011 | Nelson |
| 8,006,764 | B2 | 8/2011 | Adamek et al. |
| 8,146,670 | B2 | 4/2012 | Ellis et al. |
| 8,205,670 | B2 | 6/2012 | Nelson |
| 2005/0051342 | A1 | 3/2005 | Campbell et al. |
| 2006/0042791 | A1 | 3/2006 | Hosie et al. |

* cited by examiner

METHOD AND SYSTEM FOR HYDRAULICALLY PRESETTING A METAL SEAL

CROSS REFERENCE TO RELATED APPLICATIONS

This application claims priority to and benefit of U.S. Non-Provisional patent application Ser. No. 13/063,927, entitled "Method and System for Hydraulically Presetting a Metal Seal," filed Mar. 14, 2011, which is herein incorporated by reference in its entirety, and which claims priority to and benefit of PCT Patent Application No. PCT/US2009/059877, entitled "Method and System for Hydraulically Presetting a Metal Seal," filed Oct. 7, 2009, which is herein incorporated by reference in its entirety, and which claims priority to and benefit of U.S. Provisional Patent Application No. 61/114,944, entitled "Method and System for Hydraulically Presetting a Metal Seal", filed on Nov. 14, 2008, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as casings, trees, manifolds, and the like, that facilitate drilling and/or extraction operations.

The wellhead components may be coupled together, for example, via a flange coupling, a FastLock Connector (available from Cameron International Corporation, Houston, Tex.), or any suitable fastening system. In addition, it may be desirable to employ a metal-to-metal seal between wellhead components. Metal seals are well-suited to withstand high temperatures and pressures, thermal cycling, and harsh chemicals. Accordingly, it may be desirable to enable quick and easy setting of the metal seals between the wellhead components and coupling of the wellhead components.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present technique include a system and method that addresses one or more of the above-mentioned challenges of setting metal seals in a mineral extraction system. As explained in greater detail below, the disclosed embodiments include a hydraulic tool configured to land on a wellhead component, such as a tubing spool, and couple to a hanger within another wellhead component, such as a casing spool. A metal-to-metal seal may be disposed between the hanger and the tubing spool to seal an annular space therebetween. When the hydraulic tool is coupled to the hanger, for example, via a hydraulic or mechanical coupling assembly, fluid pressure may be applied to the tool. The fluid pressure may move the spools axially together, thereby setting the metal-to-metal seal between the hanger and the tubing spool. While the spools are held together hydraulically, one or more fasteners may be secured to couple the spools together with the metal-to-metal seal in the set state. This technique may be preferable to a system in which the spools are brought together, and the metal-to-metal seal is set, by applying radial force to the fasteners.

Figure 1:
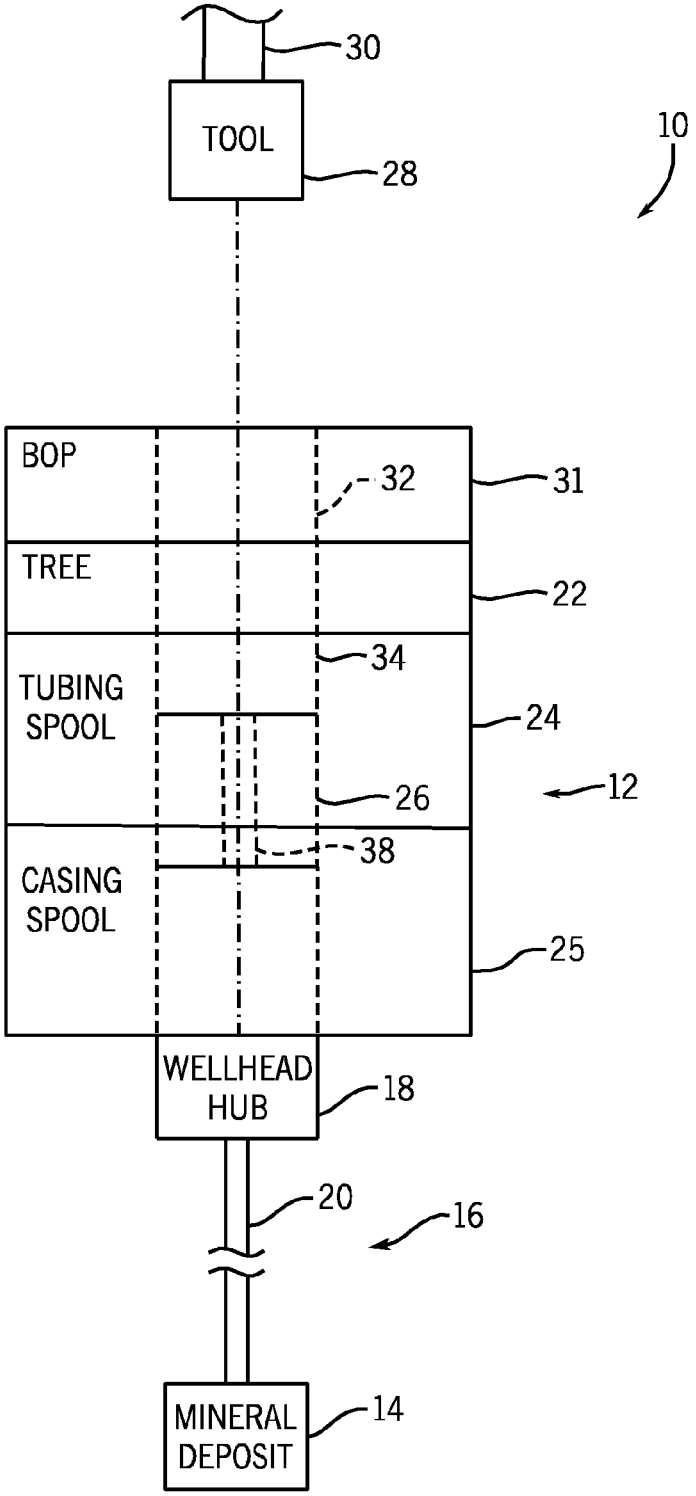
FIG. 1 is a block diagram illustrating a mineral extraction system in accordance with an embodiment of the present invention.

FIG. 1 is a block diagram that illustrates an embodiment of a mineral extraction system 10. As discussed below, one or more metal-to-metal seals may be employed throughout the system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and designed to connect the wellhead 12 to the well 16.

The wellhead 12 may include multiple components that control and regulate activities and conditions associated with the well 16. For example, the wellhead 12 generally includes bodies, valves, and seals that route produced minerals from the mineral deposit 14, regulate pressure in the well 16, and inject chemicals down-hole into the well bore 20. In the illustrated embodiment, the wellhead 12 includes what is colloquially referred to as a Christmas tree 22 (hereinafter, a tree), a tubing spool 24, a casing spool 25, and a hanger 26 (e.g., a tubing hanger and/or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 31 may also be included, either as a part of the tree 22 or as a separate device. The BOP may consist of a variety of valves, fittings, and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular subsea or surface mineral extraction system 10 that is run from an offshore vessel or surface system. The tubing spool 24 includes a tubing spool bore 34. The tubing spool bore 34 connects (e.g., enables fluid communication between) the tree bore 32 and the well 16. Thus, the tubing spool bore 34 may provide access to the well bore 20 for various completion and workover procedures. For example, components can be run down to the wellhead 12 and disposed in the tubing spool bore 34 to seal off the well bore 20, to inject chemicals down-hole, to suspend tools down-hole, to retrieve tools down-hole, and so forth.

As will be appreciated, the well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is typically disposed within the wellhead 12 to secure tubing and casing suspended in the well bore 20, and to provide a path for hydraulic control fluid, chemical injections, and so forth. The hanger 26 includes a hanger bore 38 that extends through the center of the hanger 26, and that is in fluid communication with the tubing spool bore 34 and the well bore 20. One or more seals, such as metal-to-metal seals, may be disposed between the hanger 26 and the tubing spool 24 and/or the casing spool 25.

Figure 2:
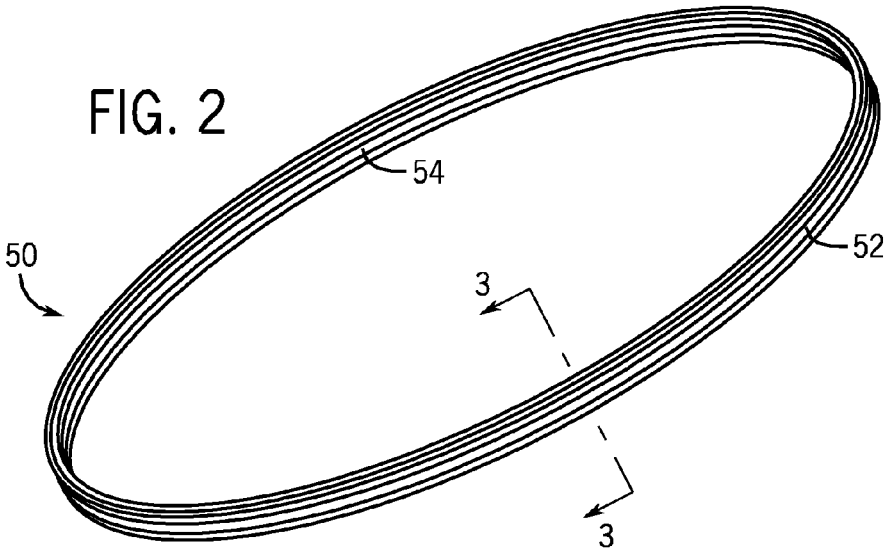
FIG. 2 is a perspective view of an exemplary metal-to-metal seal in accordance with an embodiment of the present invention.
Figure 3:
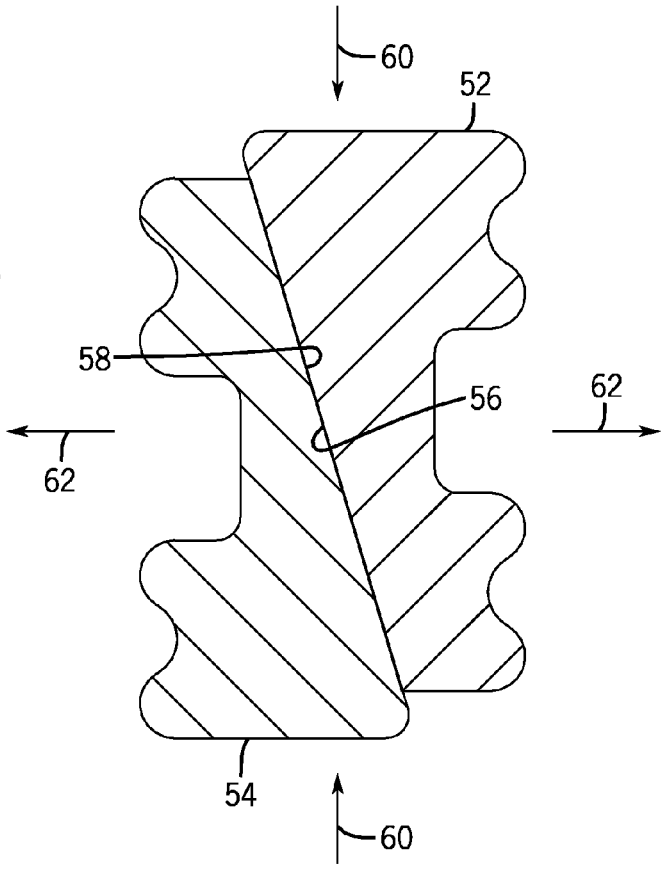
FIG. 3 is a cross-sectional view of the metal-to-metal seal of FIG. 2 taken along a line 3-3.

FIGS. 2 and 3 illustrate an exemplary metal-to-metal seal 50 known as a CANH seal (available from Cameron International Corporation, Houston, Tex.). As will be appreciated, disclosed embodiments demonstrate setting the exemplary CANH seal; however, other metal-to-metal seals may be set using the described method and/or system. As illustrated in FIG. 2, the CANH seal includes two concentric metal ring components 52 and 54. The components 52 and 54 may have a generally wedge-shaped cross-section, as illustrated in FIG. 3. Complimentary frusto-conical surfaces 56 and 58 on the ring components 52 and 54, respectively, may enable the components 52 and 54 to fit together (e.g., wedge together) to form the metal-to-metal seal 50. The seal 50 may be disposed in an annular space between wellhead components, as described in more detail below. By applying axial pressure to the seal 50 (i.e., along the lines 60), the components 52 and 54 are pressed together and expand radially (i.e., along the lines 62). The radial expansion of the ring components 52 and 54, as well as the tight metal-to-metal seal between the components 52 and 54, ensures a secure metal seal between wellhead components.

Figure 4:
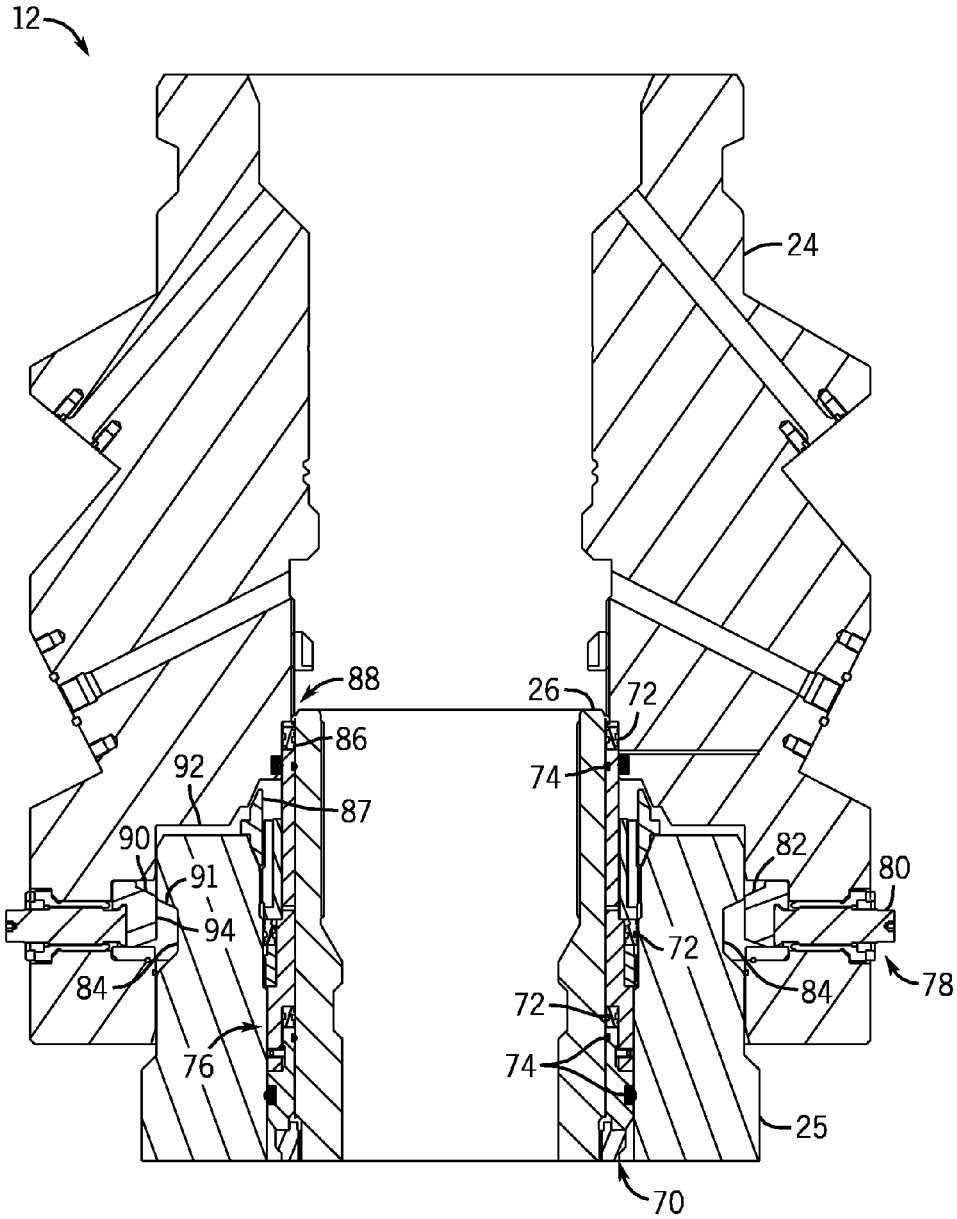
FIG. 4 is a cross-sectional view of exemplary wellhead components in accordance with an embodiment of the present invention.

FIG. 4 illustrates exemplary embodiments of the tubing spool 24, the casing spool 25, and the hanger 26. As illustrated, the hanger 26 may be secured to the casing spool 25, with one or more seals disposed in an annular space 70 between the hanger 26 and the spool 25. For example, one or more metal-to-metal seals 72 and one or more elastomer seals 74 may be included in a seal assembly 76 between the hanger 26 and the casing spool 25. The tubing spool 24 may be landed axially on top of the casing spool 25 and coupled to the casing spool 25 using one or more couplings 78 (e.g., Fast-Lock couplings, available from Cameron International Corporation, Houston, Tex.). In the illustrated embodiment, the couplings 78 include a fastener 80 adapted to advance a locking segment 82 radially into a complimentary groove 84 on the casing spool 25. An upper metal-to-metal seal 86 may seal an annular space 88 between the hanger 26 and the tubing spool 24. In addition, a metal-to-metal joint seal 87 may seal the space between the tubing spool 24 and the casing spool 25.

In some instances, the upper metal-to-metal seal 86 and the metal-to-metal joint seal 87 may be set by advancing the locking segment 82 radially into the groove 84. An energizing taper 90 on the locking segment 82, in conjunction with a corresponding taper 91 on the groove 84, may cause the tubing spool 24 to move axially downward with respect to the casing spool 25 when the fastener 80 advances the segment 82 radially inward. That is, a radial inward force on the fastener 80 may cause the tubing spool 24 and the casing spool 25 to move axially together, closing a gap 92 between the components. This axial movement may set the seals 86 and 87 by axially compressing and radially expanding the metal components (e.g., 52 and 54) of the seals 86 and 87. However, this setting method may be unsatisfactory, for example, because a vertical face 94 of the locking segment 82 may catch on the surface of the casing spool 25 adjacent to the groove 84. In addition, the force required to advance the fastener 80 radially inward may be very great. Accordingly, it may be desirable to set the seals 86 and 87 using an alternative method prior to securing the tubing spool 24 and the casing spool 25 via the couplings 78.

Figure 5:
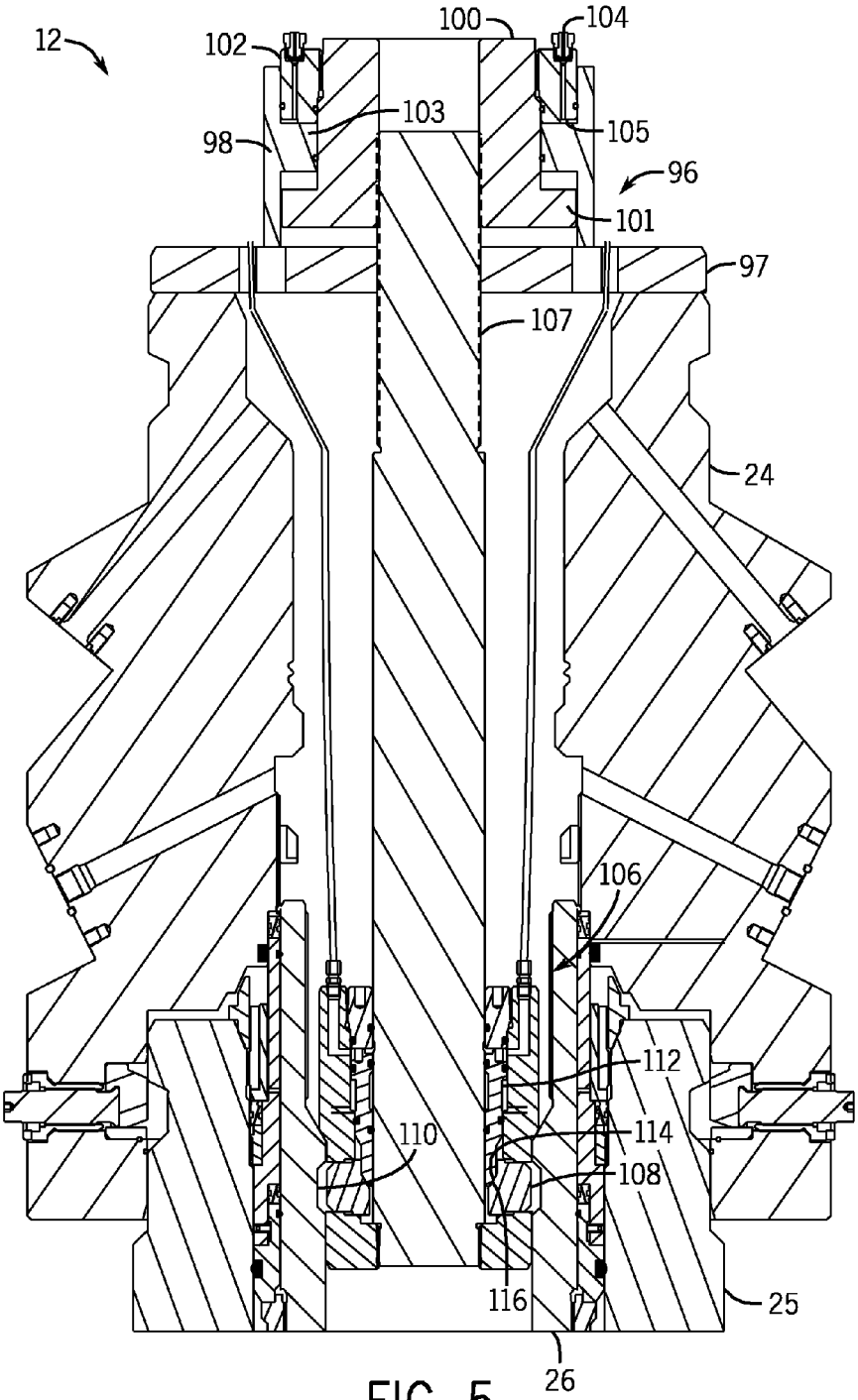
FIGS. 5-7 are cross-sectional views of an exemplary hydraulic tool for presetting a metal-to-metal seal in accordance with an embodiment of the present invention.

FIG. 5 illustrates a hydraulic tool 96 which may facilitate hydraulically pre-setting the seals 86 and 87. In the illustrated embodiment, the hydraulic tool 96 may be run into and secured to the hanger 26. The hydraulic tool 96 may include, for example, an upper tool 97 which lands on the tubing spool 24 and is stationary with respect to the tubing spool 24. A piston 98 may be coupled to and/or disposed above the upper tool 97 and situated about an annular member 100 having an exterior protruding portion 101. The piston 98 may be movable relative to the annular member 100. Another annular member 102 may be threaded onto the annular member 100. An interior protruding portion 103 of the piston 98 may cooperate with the exterior protruding portion 101 of the annular member 100 and the annular member 102 to block axial movement of the piston 98 relative to the annular member 100 past a certain distance (e.g., after the seals 86 and 87 are set). In addition, one or more pressure ports 104 through the annular member 102 may facilitate application of fluid pressure to an annular chamber 105 defined by the piston 98, the annular member 100, and the annular member 102. Increased fluid pressure in the annular chamber 105 may act on the piston 98, thereby enabling downward axial movement of the piston 98, the upper tool 97, and the tubing spool 24.

The hydraulic tool 96 may be coupleable to the hanger 26 via a hydraulic coupling assembly 106 disposed about a shaft 107 coupled to the annular member 100. The hydraulic coupling assembly 106 may include, for example, a locking component 108, which may be moved radially outward from the shaft 107 into a coupling groove 110 in the hanger 26. The locking component 108 may include, for example, a ring, such as a C-ring or a split ring, or a plurality of segments. An actuating member 112 may be disposed above the locking component 108 within the coupling assembly 106. Complimentary energizing tapers 114 and 116 on the locking component 108 and the actuating member 112, respectively, may facilitate radial movement of the locking component 108 in response to axial movement of the actuating member 112. That is, downward axial movement of the actuating member 112 may result in outward radial movement of the locking component 108 as the energizing tapers 114 and 116 slide past one another, as illustrated in FIG. 6.

Figure 6:
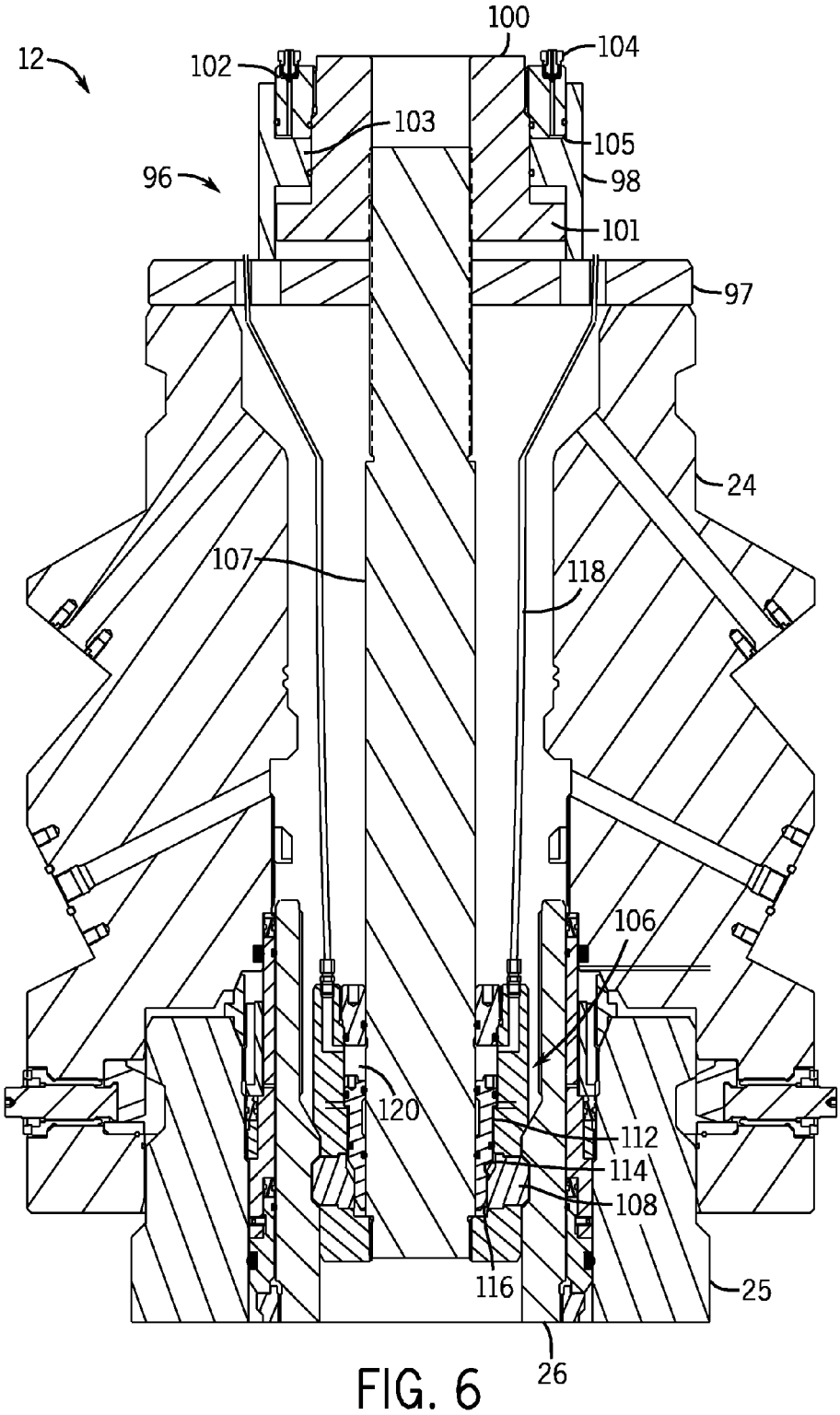

FIG. 6 illustrates the hydraulic tool 96 coupled to the hanger 26. Axial movement of the actuating member 112 may be achieved via fluid pressure applied through one or more hydraulic ports 118. Increased pressure in a sealed volume 120 within the hydraulic coupling assembly 106 may force the actuating member 112 to move down relative to the shaft 107. Accordingly, the shaft 107 may be coupled to the hanger 26, and by extension to the casing spool 25, by applying pressure through the hydraulic ports 118, thereby moving the actuating member 112 axially downward and moving the locking component 108 radially outward. Pressure may be maintained in the hydraulic coupling assembly 106 to retain the locking component 108 in the locked position, as illustrated in FIG. 6.

Figure 7:
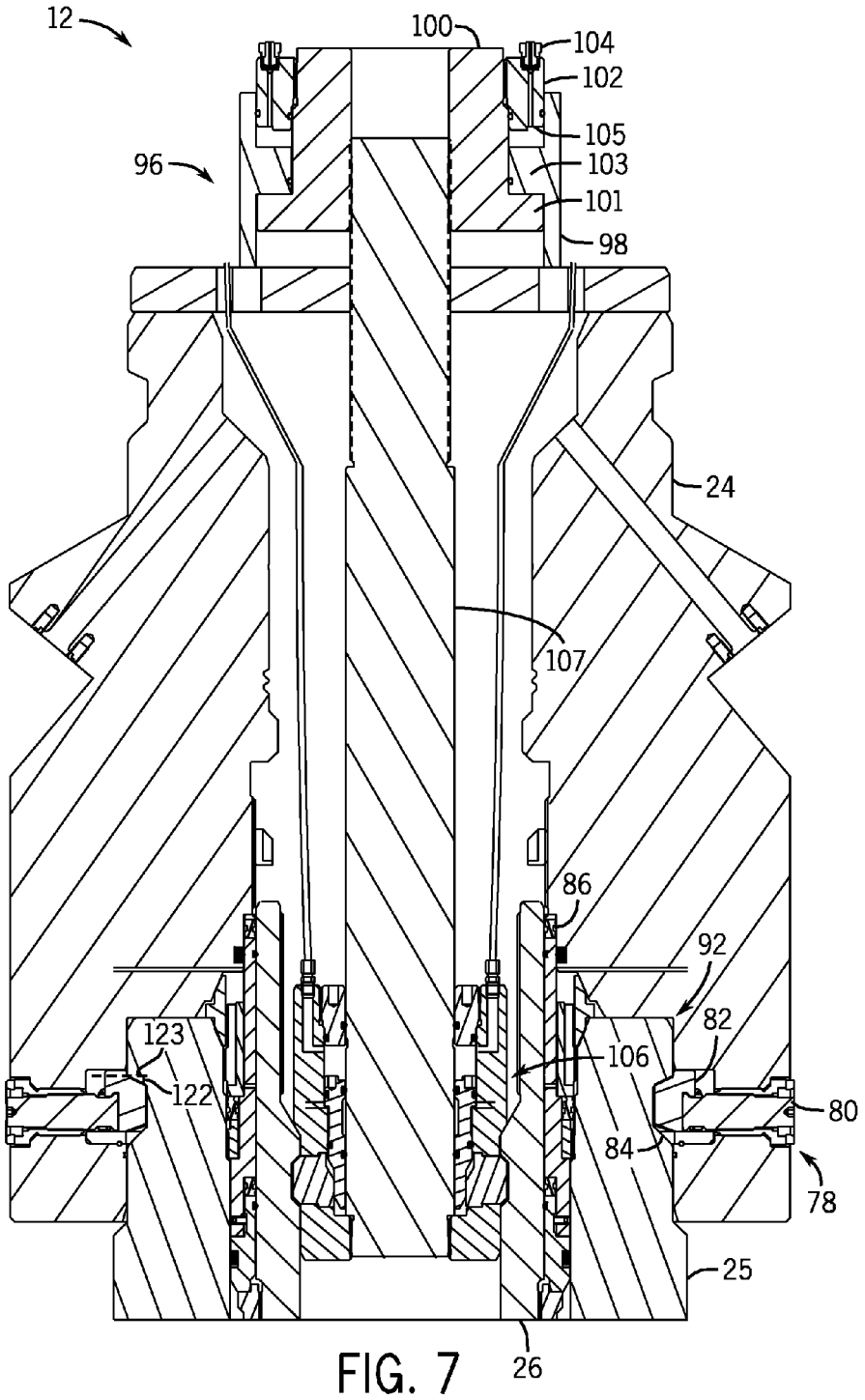

After the shaft 107 is secured to the hanger 26, the piston 98 may be actuated to move the tubing spool 24 downward with respect to the casing spool 25, as illustrated in FIG. 7. In the illustrated embodiment, pressure may be applied through the pressure ports 104 into the annular chamber 105, thereby moving the piston 98 axially downward with respect to the annular member 100. The piston 98, which is coupled to the upper tool 97, pushes the tubing spool 24 downward onto the casing spool 25. This axial movement also sets (i.e., axially compresses and radially expands) the upper metal-to-metal seal 86 between the hanger 26 and the tubing spool 24. In addition, the gap 92 between the tubing spool 24 and the casing spool 25 is substantially closed, and the metal-to-metal joint seal 87 between the spools 24 and 25 is set.

While the wellhead components are held in this sealed state by hydraulic pressure applied through the pressure ports 104, the couplings 78 may be secured to fix the tubing spool 24 and the casing spool 25 together. That is, the fasteners 80 may be tightened to advance the locking segments 82 radially inward into the grooves 84, thereby securing the tubing spool 24 to the casing spool 25. Because the spools 24 and 25 are moved together via hydraulic pressure prior to advancing the fasteners 80, the locking segments 82 may be easily advanced into the grooves 84 with less force than would be required if advancement of the locking segments 82 were moving the spools 24 and 25 together. For example, the locking segments 82 may be axially aligned with the groove 84 after actuation of the piston 98 to induce axial closure of the gap 92 between the spools 24 and 25. In addition, a tip angle 122 on the locking segment 82 may be defined as the angle between the energizing taper 90 and a horizontal axis, illustrated as a line 123. In an exemplary embodiment, the tip angle may be less than 45 degrees, such as in the range of 15-25 degrees.

After the couplings 78 are secured, the hydraulic tool 96 may be disengaged from the hanger 26 and retrieved from the wellhead 12. That is, application of hydraulic pressure via the pressure ports 104 may cease, or negative pressure (i.e., suction) may be applied via the pressure ports 104. As a result of the pressure drop, the actuating members 112 may move axially upward, thereby enabling the locking component 108 to retract from the coupling groove 110. Essentially, the hydraulic coupling assembly 106 may return to the state it was in when it was lowered into the hanger 26, as illustrated in FIG. 5. When the locking component 108 is retracted from the groove 110, the hydraulic tool 96 may be retrieved from the wellhead 12.

Figure 8:
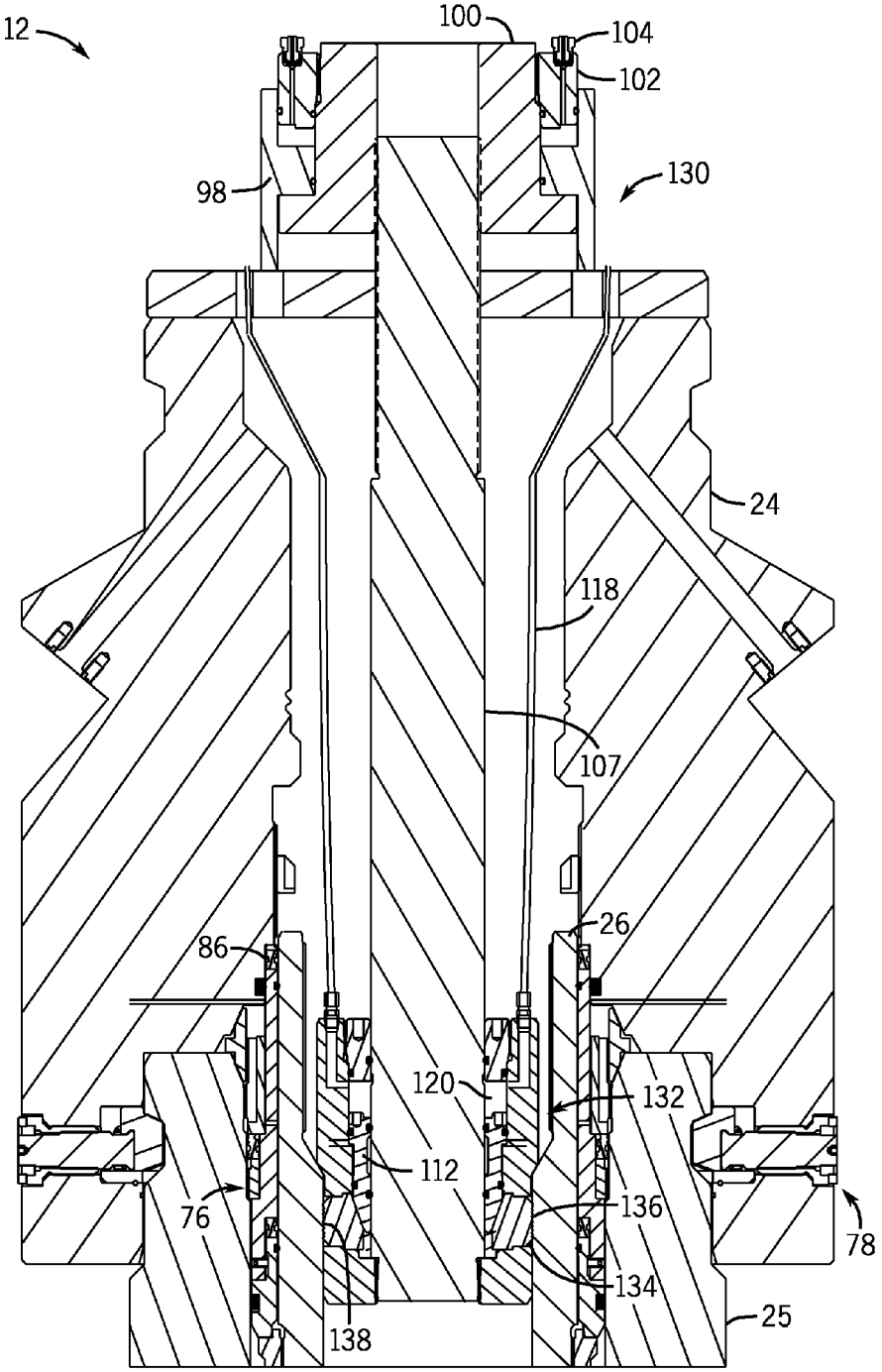
FIG. 8 is a cross-sectional view of another exemplary hydraulic tool for presetting a metal-to-metal seal in accordance with an embodiment of the present invention.
Figure 9:
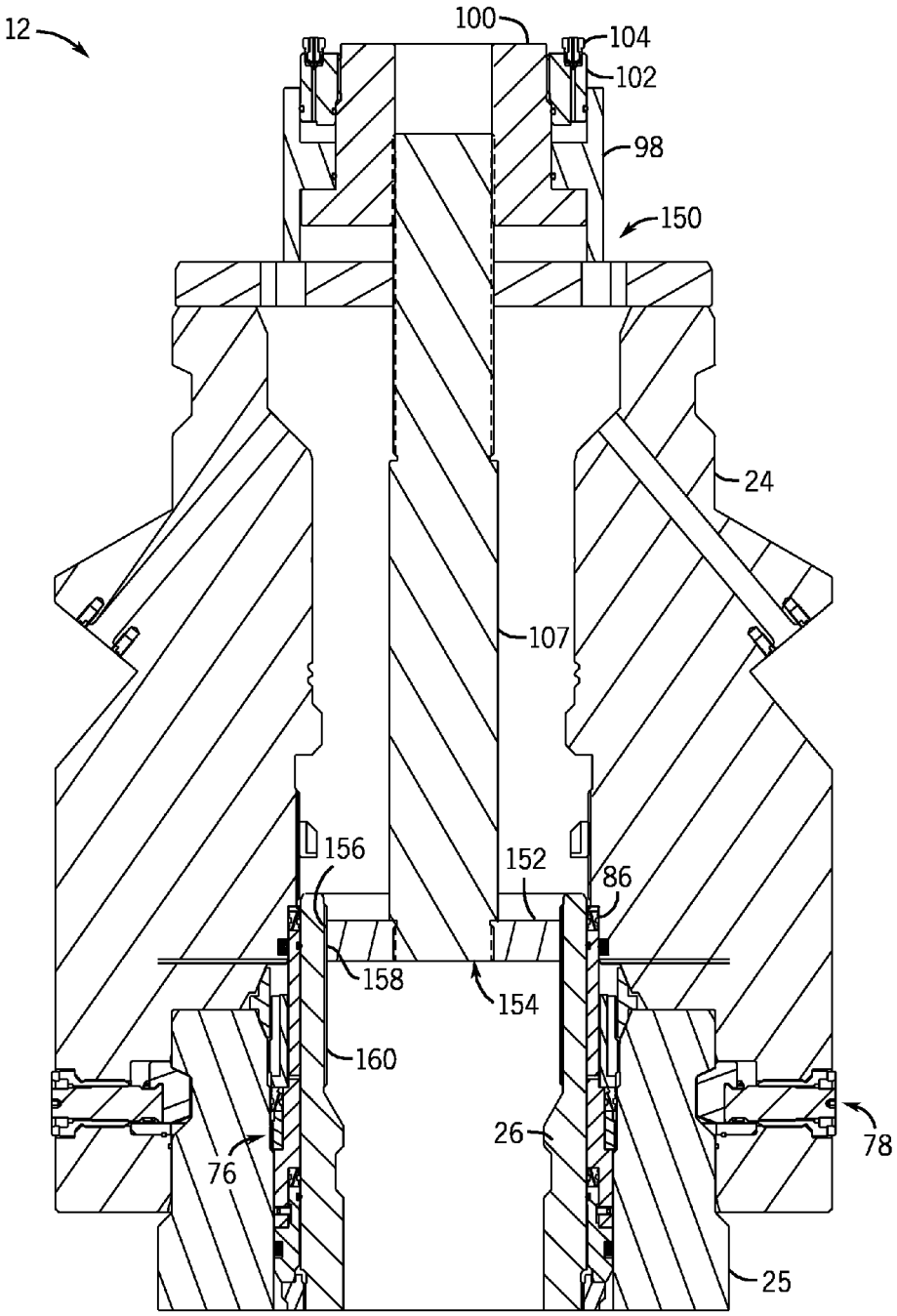
FIG. 9 is a cross-sectional view of an additional exemplary hydraulic tool for presetting a metal-to-metal seal in accordance with an embodiment of the present invention.

Additional embodiments of the hydraulic tool are illustrated in FIGS. 8 and 9. In the embodiment illustrated in FIG. 8, an exemplary hydraulic tool 130 may operate substantially similarly to the hydraulic tool 96 described in FIGS. 4-7. That is, the hydraulic tool 130 may be used to preset the upper metal-to-metal seal 86 and the metal-to-metal joint seal 87 while the couplings 78 are secured. A hydraulic coupling assembly 132 on the hydraulic tool 130 may include, for example, the actuating member 112 which moves via hydraulic pressure applied to the sealed volume 120 through the hydraulic ports 118. One or more locking segments 134 may include teeth 136, which can grip an interior surface 138 of the hanger 26 when the segments 134 are expanded radially outward by the actuating member 112. The interior surface 138 may have cooperating teeth, a roughened texture, or another preparation to enhance the grip of the toothed locking segments 134. In another embodiment, the toothed locking segments 134 may enable presetting of the upper metal-to-metal seal 86 even if the hanger 26 was not specially prepared. That is, the toothed locking segments 134 may grip even a smooth interior surface 138 to enable the hydraulic tool 130 to push the tubing spool 24 down onto the casing spool 25, as described above with respect to FIG. 7.

Another embodiment of an exemplary hydraulic tool 150 is illustrated in FIG. 9. In the illustrated embodiment, the hydraulic tool 150 may be secured to the hanger 26 via a threaded nut 152. For example, the threaded nut 152 may be secured around an end portion 154 of the shaft 107 via a compression fit, pins, soldering, or any suitable coupling method. The threaded nut 152 may have external threading 156, which is configured to cooperate with internal threading 158 on an interior surface 160 of the hanger 26. The hydraulic tool 150 may therefore be secured to the hanger 26 and the casing spool 25 by inserting the threaded nut 152 into the hanger 26 and rotating the shaft 107 and the coupled nut 152 with respect to the hanger 26. After the hydraulic tool 150 is coupled to the hanger 26, the seals 86 and 87 may be preset as described above with respect to FIG. 7. That is, pressure may be exerted on the piston 98 by applying fluid pressure through the pressure ports 104. The piston 98 may then move axially downward, pushing the tubing spool 24 closer to the casing spool 25. The couplings 78 may be secured while the pressure is applied through the pressure ports 104. When the pressure is released, the upper metal-to-metal seal 86 and the metal-to-metal joint seal 87 are sealingly secured in place between the hanger 26, the tubing spool 24, and the casing spool 25.

Figure 10:
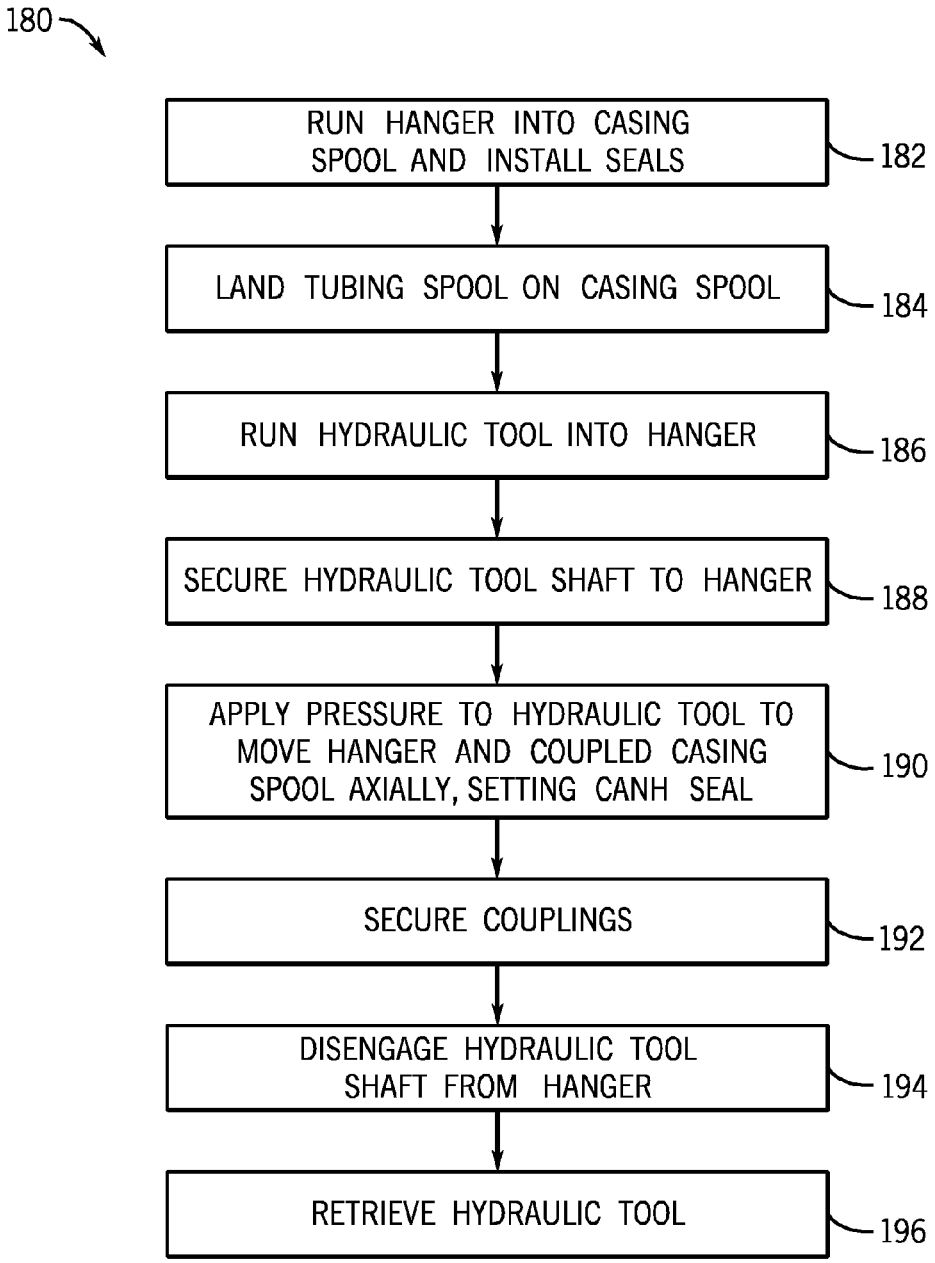
FIG. 10 is a flow chart of an exemplary process for hydraulically presetting a metal-to-metal seal in accordance with an embodiment of the present invention.

An exemplary process 180 for hydraulically presetting the upper metal-to-metal seal 86 is illustrated in FIG. 10. The process 180 may be initiated by running the hanger 26 into the casing spool 25 and installing the seal assembly 76 (block 182). The tubing spool 24 may then be landed on the casing spool 25 (block 184). The hydraulic tool (e.g., exemplary hydraulic tool 96, 130, or 150) may be run into the hanger 26 (block 186) and secured to the hanger 26 (block 188). Securing the tool to the hanger 26 may involve hydraulically advancing the locking segments 82 into the grooves 84 in the hanger 26 (FIGS. 4-7), hydraulically securing the toothed locking segments 134 to the interior surface 138 of the hanger 26 (FIG. 8), mechanically securing the threaded nut 152 to the hanger 26 (FIG. 9), or any suitable method for securing the hydraulic tool to the hanger 26.

After the hydraulic tool is secured to the hanger 26, pressure may be applied to the hydraulic tool via the pressure ports 104 (block 190). The hydraulic pressure moves the piston 98 axially downward, thereby pushing the tubing spool 24 closer to the casing spool 25 coupled to the hanger 26 and substantially closing the gap 92 between the spools 24 and 25. The couplings 78 may then be secured while pressure is applied to the hydraulic tool (block 192). After the couplings 78 are secured, the pressure may be released, and the hydraulic tool may be disengaged from the hanger 26 (block 194). Again, disengagement of the tool from the hanger 26 may depend on the engagement employed in block 188. For example, if the hydraulic tool is secured to the hanger 26 hydraulically (e.g., via a hydraulic coupling assembly 106 or 132, as in FIGS. 4-8), the hydraulic pressure through the hydraulic ports 118 may be released to disengage the coupling assembly from the hanger 26. If the hydraulic tool is secured to the hanger 26 mechanically (e.g., via the threaded nut 152, as in FIG. 9), disengagement may involve mechanical disassembly. When the hydraulic tool is disengaged from the hanger 26, the tool may be retrieved from the wellhead 12 through the bores 32 and 34 (block 196).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method, comprising:

operating a retrievable tool to provide an actuation force to cause a relative movement between first and second tubular components of a mineral extraction system;

axially compressing a seal disposed between the first and second tubular components in response to the relative movement caused by the actuation force; and coupling the first and second tubular components together with a coupling assembly after axially compressing the seal, wherein coupling comprises actuating a fastener of the coupling assembly to move radially from a first position to a second position relative to the first and second tubular components, the first position of the fastener enables the first and second tubular components to move axially relative to one another, and the second position of the fastener blocks the first and second tubular components from moving axially relative to one another.

2. The method of claim 1, wherein operating the retrievable tool comprises hydraulically driving a piston to provide the actuation force.

3. The method of claim 1, wherein operating the retrievable tool comprises providing a linear actuation force.

4. The method of claim 1, wherein operating the retrievable tool comprises causing a relative axial movement between the first and second tubular components.

5. The method of claim 1, comprising landing the retrievable tool on an axial abutment of the mineral extraction system.

6. The method of claim 1, comprising coupling the retrievable tool to the mineral extraction system prior to operating the retrievable tool to provide the actuation force to cause the relative movement between the first and second tubular components.

7. The method of claim 6, wherein coupling the retrievable tool comprises hydraulically actuating a tool coupling to couple the retrievable tool to the mineral extraction system.

8. The method of claim 6, wherein coupling the retrievable tool comprises actuating a tool coupling to drive a plurality of locking segments into locked positions relative to the mineral extraction system.

9. The method of claim 8, wherein actuating the tool coupling comprises driving the plurality of locking segments radially into the locked positions.

10. The method of claim 8, wherein actuating the tool coupling comprises driving the plurality of locking segments into engagement with one or more locking grooves.

11. The method of claim 6, wherein coupling the retrievable tool comprises actuating a threaded tool coupling to couple the retrievable tool to the mineral extraction system.

12. The method of claim 1, wherein coupling the first and second tubular components together comprises actuating the coupling assembly after the relative movement causes a reduction of a gap between the first and second tubular components and causes axial compression of the seal.

13. The method of claim 1, wherein actuating the fastener of the coupling assembly to move from the first position to the second position comprises retaining the first and second tubular components in an axial position relative to one another to maintain axial compression of the seal.

14. The method of claim 1, wherein actuating the fastener of the coupling assembly comprises actuating a radial fastener of the coupling assembly to move radially from the first position to the second position to interlock and prevent axial movement between the first and second tubular components.

15. The method of claim 1, comprising retrieving the retrievable tool after coupling the first and second tubular components together with the coupling assembly.

16. The method of claim 1, wherein coupling comprises contacting the first and second tubular components with the coupling assembly.

17. The method of claim 1, wherein the second position of the fastener prevents the first and second tubular components from moving axially relative to one another.

18. A system, comprising:

a retrievable tool, comprising:

a tool coupling configured to selectively couple the retrievable tool to a mineral extraction system; and an actuator configured to provide an actuation force to cause a relative movement between first and second tubular components of the mineral extraction system, wherein the relative movement is configured to cause axial compression of a seal disposed between the first and second tubular components prior to coupling together the first and second tubular components with a coupling assembly having a radial fastener that selectively blocks axial movement of the first and second tubular components relative to one another.

19. The system of claim 18, wherein the actuator comprises a hydraulic actuator configured to hydraulically drive a piston to provide the actuation force.

20. The system of claim 18, wherein the actuator is configured to provide the actuation force to cause a relative axial movement between first and second tubular components.

21. The system of claim 18, wherein the retrievable tool is configured to land on an axial abutment of the mineral extraction system.

22. The system of claim 18, wherein the retrievable tool comprises a tool coupling configured to selectively couple to the mineral extraction system prior to operating the actuator to provide the actuation force to cause the relative movement between the first and second tubular components.

23. The system of claim 22, wherein the tool coupling comprises a hydraulically actuated tool coupling.

24. The system of claim 22, wherein the tool coupling comprises a plurality of locking segments that selectively move radially into locked positions relative to the mineral extraction system.

25. The system of claim 22, wherein the tool coupling comprises a threaded tool coupling.

26. The system of claim 18, wherein the radial fastener is configured to interlock and prevent axial movement between the first and second tubular components.

27. The system of claim 18, wherein the coupling assembly is configured to contact the first and second tubular components.

28. The method of claim 18, wherein the radial fastener selectively prevents axial movement of the first and second tubular components relative to one another.

29. A system, comprising:

first and second tubular components of a mineral extraction system;

a seal disposed between the first and second tubular components; and a coupling assembly disposed between the first and second tubular components, wherein the coupling assembly is configured to couple together the first and second tubular components after axial compression of the seal in response to a relative movement between the first and second tubular components caused by a retrievable tool, wherein the coupling assembly comprises a fastener configured to move radially from a first position to a second position relative to the first and second tubular components, the first position of the fastener enables the first and second tubular components to move axially relative to one another, and the second position of the fastener blocks the first and second tubular components from moving axially relative to one another.

30. The system of claim 29, wherein the coupling assembly contacts the first and second tubular components.

31. The system of claim 29, wherein the coupling assembly is configured to couple together an axial end portion of the first tubular component with a corresponding axial end portion of the second tubular component.

32. The method of claim 29, wherein the second position of the fastener prevents the first and second tubular components from moving axially relative to one another.

33. A system, comprising:

a retrievable tool, comprising:

a tool coupling comprising a plurality of locking segments that selectively move radially into locked positions to couple the retrievable tool to a mineral extraction system; and an actuator configured to provide an actuation force to cause a relative movement between first and second tubular components of the mineral extraction system, wherein the relative movement is configured to cause axial compression of a seal disposed between the first and second tubular components prior to coupling together the first and second tubular components with a coupling assembly.

* * * * *